US006472604B2

(12) United States Patent
Nakamura et al.

(10) Patent No.: US 6,472,604 B2
(45) Date of Patent: Oct. 29, 2002

(54) SEAL CONSTRUCTION OF POLYMER INSULATOR

(75) Inventors: Itsushi Nakamura; Takashi Imakoma, both of Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/802,629

(22) Filed: Mar. 9, 2001

(65) Prior Publication Data

US 2001/0020544 A1 Sep. 13, 2001

(30) Foreign Application Priority Data

Mar. 13, 2000 (JP) ..... 2000-069028

(51) Int. Cl.[7] ..... H01B 19/00

(52) U.S. Cl. ..... 174/138 R; 174/174; 174/176; 174/189

(58) Field of Search ..... 174/189, 192, 174/138 R, 168, 174, 176, 179, 178, 209, 211

(56) References Cited

U.S. PATENT DOCUMENTS 4,435,615 A * 3/1984 Kaczerginski et al. ..... 174/179
5,363,266 A * 11/1994 Wiseman et al. ..... 361/117
5,563,379 A * 10/1996 Kunieda et al. ..... 174/169
5,915,761 A * 6/1999 Moriya et al. ..... 174/209
6,140,573 A * 10/2000 Smith et al. ..... 174/179
6,282,783 B1 * 9/2001 Abe ..... 174/179

* cited by examiner

*Primary Examiner*—Dean A. Reichard
*Assistant Examiner*—Jinhee J Lee
(74) *Attorney, Agent, or Firm*—Burr & Brown

(57) ABSTRACT

A seal construction of a polymer insulator has a core member, an outer cover member including a sheath portion and sheds, which is arranged on an outer surface of the core member, and a securing metal fitting is arranged on each end of the core member. A tip portion of the sheath portion is arranged between the securing metal-fitting and the core member, and a sealant is arranged between an inner surface of the securing metal fitting and an outer surface of the tip portion of the sheath portion. The seal construction mentioned above includes a small rib projecting radially outward from the sheath portion of the outer cover member. The small rib has a side surface connected to an open end portion of the securing metal fitting via the sealant, and the sealant does not protrude from a portion between the side surface of the small rib and the open end portion of the securing metal fitting.

7 Claims, 3 Drawing Sheets

FIG. 4 - Prior Art
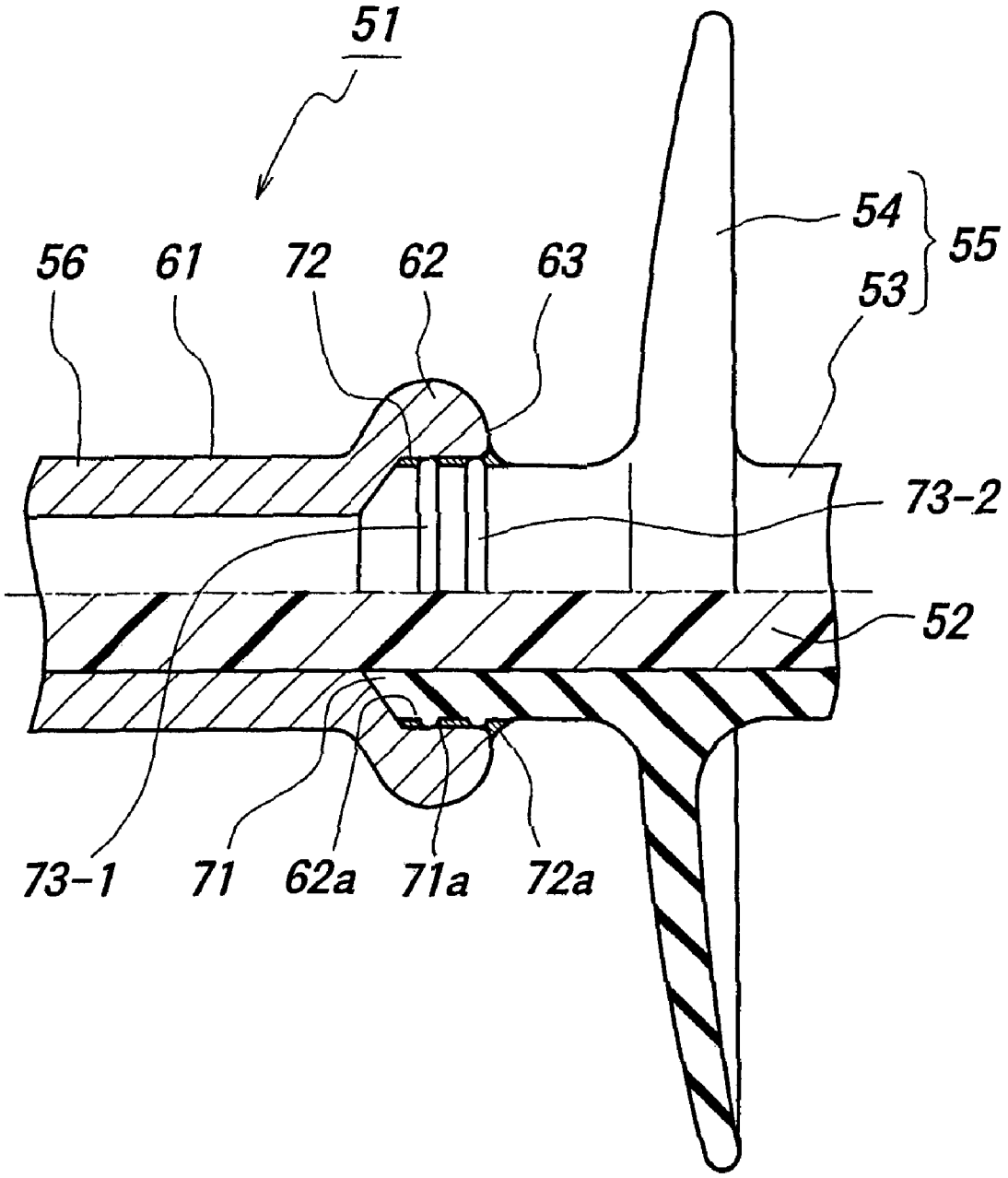

SEAL CONSTRUCTION OF POLYMER INSULATOR

BACKGROUND OF THE INVENTION

1. Field of the Invention

The present invention relates to a seal construction of a polymer insulator having a core member, an outer cover member including a sheath portion and sheds, which is arranged on an outer surface of the core member, and securing metal fittings arranged on both ends of the core member, and particularly relates to a seal construction between the outer cover member and the securing metal fitting.

2. Description of Related Art

Generally, a polymer insulator having a core member, an outer cover member including a sheath portion and sheds, which is arranged on an outer surface of the core member, and securing metal fittings arranged on both ends of the core member is known. Moreover, various seal constructions between the outer cover member and the securing metal fitting are also known.

FIG. 4 is a schematic view showing one embodiment of a known seal construction of the polymer insulator. In FIG. 4, a polymer insulator 51 comprises an FRP core 52 as the core member, an outer cover member 55 having a sheath portion 53 and sheds 54, which is arranged on an outer surface of the FRP core 52, and securing metal fittings 56 arranged at both ends of the FRP core 52. In FIG. 4, only one side of the polymer insulator is shown. The securing metal fitting 56 comprises a small diameter portion 61 for securing the FRP core 52 and a large diameter portion 62 arranged continuously from the small diameter portion 61 and having an open end portion 63. A tip portion 71 of the sheath portion 53 is arranged between the large diameter portion 62 and the FRP core 52. Between an inner surface 62*a* of the large diameter portion 62 and an outer surface 71*a* of the tip portion 71, a silicon sealant of a room temperature vulcanizing (RTV) type 72 is arranged as a sealant.

Moreover, a protruding portion 72*a* of the silicon sealant of RTV type 72 is protruded from an end of a portion at which the inner surface 62*a* of the large diameter portion 62 and the outer surface 71*a* of the tip portion 71 are connected. In addition, in order to improve a seal property between the inner surface 62*a* of the large diameter portion 62 and the outer surface 71*a* of the tip portion 71 of the sheath portion 53, two ring portions 73-1 and 73-2 projected from the outer surface 71*a* of the tip portion 71 of the sheath portion 53 are arranged.

As mentioned above, in the polymer insulator 51, a connection portion between the outer cover member 55 and the securing metal fitting 56 is very important for preventing in intrusion of rain water which causes a deterioration of the FRP core 52. Therefore, it is necessary to seal such a connection portion, and the connection portion requires a high reliability. In the known seal construction mentioned above, the protruded portion 72*a* of the sealant 72 is exposed at the open end portion 63 i.e. the sealant 72 is exposed to a natural environment.

Recently, a property of the sealant 72 is improved and it is possible to use the sealant 72 for a use of the polymer insulator 51. However, a property of the sealant 72 is not always equal to that of the outer cover member 55. Therefore, In order to further improve reliability, a seal construction, which does not depend on a property of the sealant 72 even when exposed to a severe natural environment, is desired.

In the known seal construction mentioned above in which the sealant 72 has the protruded portion 72*a*, if a dimension of the protruded portion 72*a* is made larger so as to improve a water immersion resistivity by keeping a long seal length, an exposed area of the sealant 72 becomes larger. Therefore, deteriorations due to rain water and ultraviolet rays become more severe, and also an anti-erosion property of the sealant becomes worse. On the other hand, if a dimension of the protruded portion 72*a* is made smaller so as to improve the problems due to the above deteriorations and antierosion property, it is not possible to maintain a seal reliability.

SUMMARY OF THE INVENTION

An object of the invention is to eliminate the drawbacks mentioned above and to provide a seal construction of a polymer insulator which can improve a water intrusion resistivity and prevent an erosion.

According to the invention, a seal construction of a polymer insulator has a core member, an outer cover member including a sheath portion and sheds, which is arranged on an outer surface of the core member, and securing metal fittings arranged on both ends of the core member, wherein a tip portion of the sheath portion is arranged between the securing metal fitting and the core member and a sealant is arranged between an inner surface of the securing metal fitting and an outer surface of the tip portion of the sheath portion. The seal construction includes be following:

(1) a small rib radially projects from the sheath portion of the outer cover member;

(2) a side surface of the small rib is connected to the open end portion of the securing metal fitting via the sealant; and (3) the sealant does not protrude from a portion between the side surface of the small rib and the open end portion of the securing metal fitting.

In the present invention, by realizing the constructions: a small rib projected from the sheath portion of the outer cover member is arranged; a side surface of the small rib is connected to an open end portion of the securing metal fitting via the sealant; and the sealant is not protruded from a portion between the side surface of the small rib and the open end portion of the securing metal fitting, it is possible to suppress an affect for the sealant due to a rain water, an ultraviolet ray and so on. Therefore, it is possible to obtain an excellent connection life of the sealant and improve a water intrusion resistivity. In addition, it is possible to eliminate a generation of erosion at the protruded portion of the sealant and thus prevent an erosion of the outer cover member.

BRIEF DESCRIPTION OF THE DRAWINGS

For a better understanding of the present invention, reference is made to the attached drawings wherein:

FIG. 4 is a schematic view showing one embodiment of a seal construction of a known polymer insulator.

DETAILED DESCRIPTION OF THE INVENTION

Figure 1:
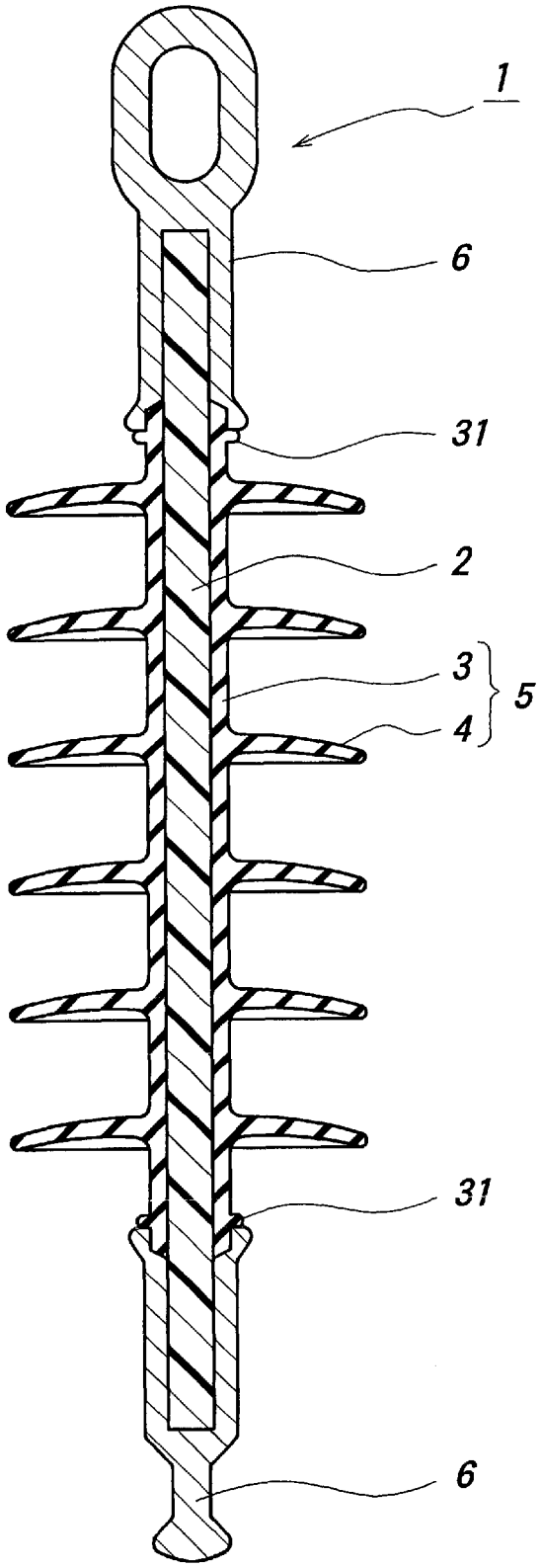
FIG. 1 is a schematic view showing one embodiment of a polymer insulator according to the invention.
Figure 2:
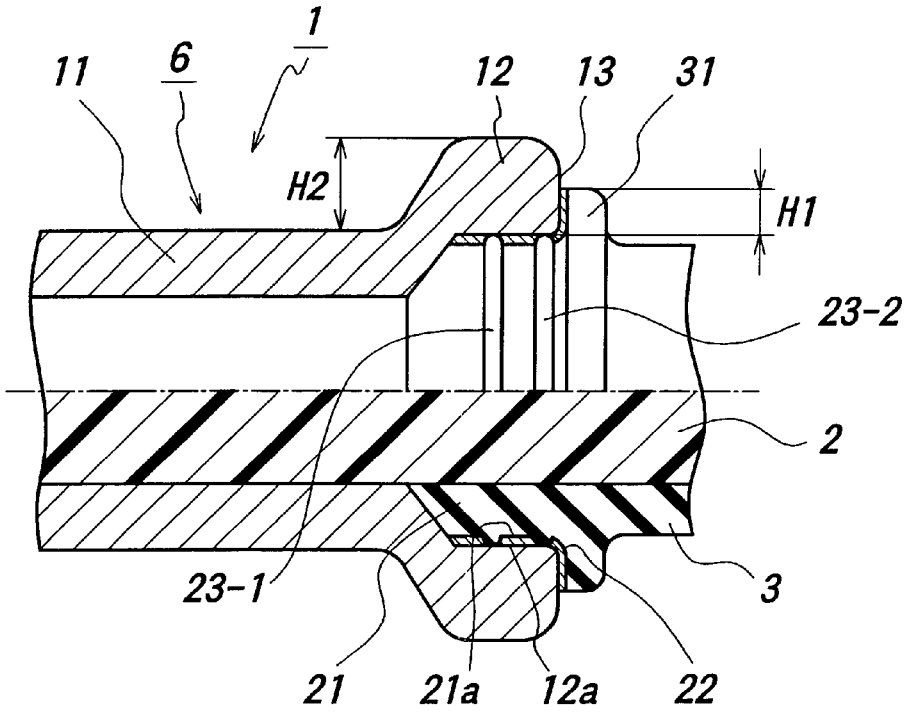
FIG. 2 is a schematic view illustrating one embodiment of a seal construction of the polymer insulator according to the invention shown in FIG. 1.

FIG. 1 is a schematic view showing one embodiment of a polymer insulator according to the invention. FIG. 2 is a schematic view showing one embodiment of a seal construction of the polymer insulator shown in FIG. 1. In the embodiment shown in FIG. 2, it should be noted that only one end of the seal construction is shown, but the same seal construction may be arranged at the other end not shown. Hereinafter, the seal construction of the polymer insulator according to the invention will be explained with reference to FIGS. 1 and 2. In this embodiment, a polymer insulator 1 comprises an FRP core 2 as a core member, an outer cover member 5 having a sheath portion 3 and sheds 4, which is arranged on an outer surface of the FRP core 2, and securing metal fittings 6 arranged at both ends of the FRP core 2.

The securing metal fitting 6 comprises a small diameter portion 11 for securing the FRP core 2 and a large diameter portion 12 arranged continuously from the small diameter portion 11 and having an open end portion 13. A tip portion 21 of the sheath portion 3 is arranged between the large diameter portion 12 and the FRP core 2. Between an inner surface 12*a* of the large diameter portion 12 and an outer surface 21*a* of the tip portion 21, a silicon sealant of a room temperature vulcanizing type 22 is arranged as a sealant. Moreover, in order to improve a seal property between the inner surface 12*a* of the large diameter portion 12 and the outer surface 21*a* of the tip portion 21 of the sheath portion 3, two ring portions 23-1 and 23-2 projected from the outer surface 21*a* of the tip portion 21 of the sheath portion 3 are arranged. The constructions mentioned above are the same as those of the known seal construction. That is to say, in the present invention, the constructions such as an FRP constituting the FRP core 2, materials constituting the outer cover member 5 such as silicon rubber, materials of metal constituting the securing metal fitting 6 and a composition of the silicon sealant of RTV type 22 are the same of those of the known polymer insulator.

Features of the seal connection of the polymer insulator according to the invention include: a small rib 31 projecting radially from the sheath portion 3 of the outer cover member 5; preferably a height H1 of the small rib 31 is lower than a height H2 of the open end portion 13; a side surface of the small rib 31 is connected to the open end portion 13 of the securing metal fitting 6 via the sealant 22; and the sealant 22 is not protruded from a portion between the side surface of the small rib 31 and the open end portion 13 of the securing metal fitting 6. Here, a meaning of "and the sealant 22 is not protruded from a portion between the side surface of the small rib 31 and the open end portion 13 of the securing metal fitting 6" is that a generation of the protruded portion 72*a* shown in the known seal construction mentioned above is eliminated but it is admitted that the sealant 22 between the side surface of the small rib 31 and the open end portion 13, of the large diameter portion 12, which faces to an atmosphere, is existent as shown in FIG. 2. In this case, It is preferred to control a thickness of an open end portion of the sealant 22 arranged between the side surface of the small rib 31 and the open end portion 13 of the large diameter portion 12, i.e., a thickness of the sealant 22 facing to an atmosphere in a range of smaller than 3 mm. Here, the reason of preferably setting the thickness of smaller than 3 mm is that the sealant exposed to an atmosphere can be made smaller and an electrical and thermal stress which causes an erosion can be reduced. From this viewpoint, it is further preferred to control the thickness in a range of smaller than 1 mm.

In the present invention, the seal property equal to or higher than that of the known seal construction can be obtained, even if the protruded portion 72*a*, which is thought to be necessary for keeping the seal property, is eliminated. This is because (1) the small rib 31 is arranged and the sealant 22 is arranged between the small rib 31 and the open end portion 13 and (2) the sealant 22 between them is connected to the sealant 22 between the inner portion 12*a* of the large diameter portion 12 and the outer surface 21*a* of the tip portion 21 and the sealant 22 is curved by substantially 90° at its connection portion.

In the present invention having the seal construction mentioned above, since the protruded portion 72*a* of the sealant of the known seal construction can be eliminated, there is no affection of a rain water, an ultraviolet ray and so on with respect to the sealant 22 positioned between the large diameter portion 12 and the tip portion 21 or the small rib 31. Moreover, as compared with the known seal construction, it is possible to enlarge a connection portion between the outer cover member 5 and the securing metal fitting 6 by an amount of the sealant 22 positioned between the small rib 31 and the open end portion 13. As a result, it is possible to maintain a connection life of the sealant 22 and to improve a water intrusion resistivity of the seal construction of the polymer insulator according to the invention. Then, since there is no protruded portion 72*a* of the sealant as the known seal construction, a generation of an erosion of the protruded portion 72*a*, which leads to an erosion of the outer cover member 5, can be eliminated. As a result, it is possible to prevent a generation of an erosion of the outer cover member 5.

The seal construction of the polymer insulator mentioned above can be obtained according to the known manufacturing method. That is to say, the FRP core 2 and the securing metal fitting 6 having respectively a predetermined shape are prepared, and the outer cover member 5 having a predetermined shape is arranged around the FRP core 2 by forming it by means of a mold. After that, the securing metal fittings 6 are set to both ends of the FRP core 2 via the sealant of RTV type 22 positioned between the large diameter portion 12 and the tip portion 21, and then the securing metal fittings 6 are clamped by using a die. As a result, the seal construction of the polymer insulator according to the invention can be obtained. When the securing metal fittings 6 are clamped by the die, there is sometimes the case such that the sealant 22 is protruded from a portion between the small rib 31 and the open end portion 13. In this case, the thus protruded sealant may be wiped before hardening.

Figure 3:
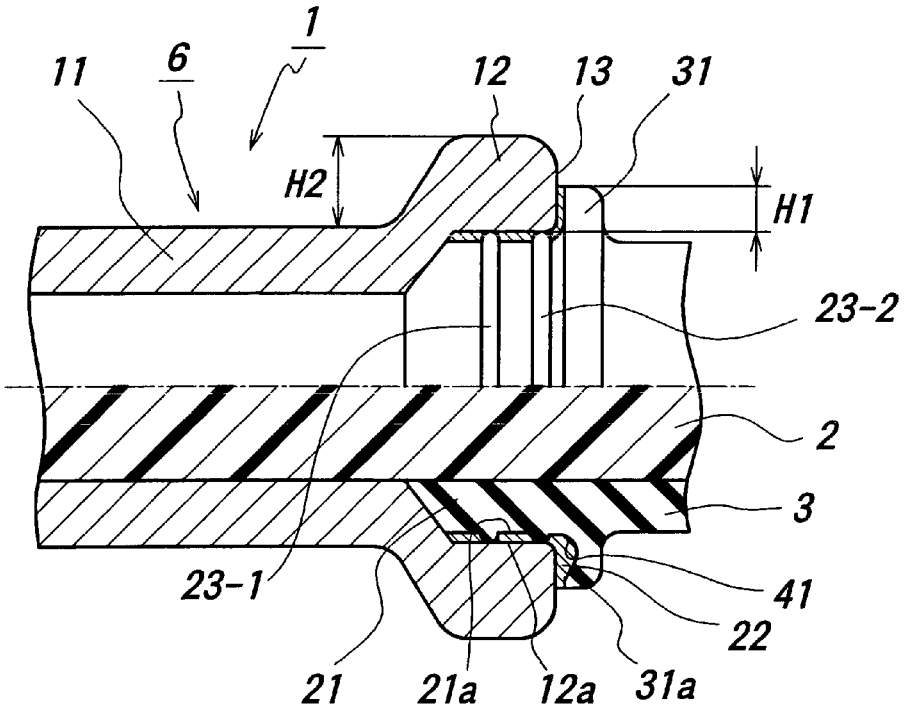
FIG. 3 is a schematic view depicting another embodiment of the seal construction of the polymer insulator according to the invention shown in FIG. 1.

FIG. 3 is a schematic view showing another embodiment of the seal construction of the polymer insulator shown in FIG. 1 according to the invention. In the embodiment shown in FIG. 3, portions similar to those of FIG. 2 are denoted by the same reference numerals, and the explanations thereof are omitted here. In the embodiment shown in FIG. 3, a feature different from the embodiment shown in FIG. 2 is that a sealant pool portion 41 is arranged by cutting a root portion of the small rib 31 of the outer cover member 5, to which the open end portion 13 is connected, at a curved portion between the inner surface 12*a* of the large diameter portion 12 and the outer surface 21*a* of the tip portion 21. The sealant pool portion 41 functions to press a tip portion 31*a* of the small rib 31 to the open end portion 13 of the large diameter portion 12 and also functions to pool the sealant 22. Therefore, in this embodiment, as compared with the embodiment shown in FIG. 2, it is possible to prevent an intrusion of a rain water from the connection portion more preferably, and thus it is possible to obtain the seal construction which can improve a water intrusion resistivity more and more.

In the embodiments mentioned above, the small rib 31 is arranged respectively with respect to the shed 4. However, it is possible to realize a function of the small rib 31 by arranging the shed 4 at a position of the small rib 31 instead.

As clearly understood from the above explanations, according to the invention, since the small rib is connected to the open end portion via the sealant and the sealant is not protruded from a portion between the small rib and the open end portion, it is possible to reduce an affection due to a rain water, an ultraviolet ray and so on with respect to the sealant. Therefore, it is possible to maintain the connection life of the sealant and to improve a water intrusion resistivity. In addition, it is possible to eliminate a generation of an erosion at the sealant intruded portion, and thus it is possible to prevent a generation of an erosion of the outer cover member.

What is claimed is:

1. A seal construction of a polymer insulator having a core member, an outer cover member including a sheath portion and sheds, which is arranged on an outer surface of the core member, and a securing metal fitting arranged on each end of the core member, wherein a tip portion of the sheath portion is arranged between the securing metal fitting and the core member and a sealant is arranged between an inner surface of the securing metal fitting and an outer surface of the tip portion of the sheath portion, comprising:

a small rib projecting radially outwardly from the sheath portion of the outer cover member, said small rib having a side surface connected to an open end portion of the securing metal fitting via the sealant, wherein the small rib does not extend radially beyond the open end portion of the securing metal fitting, and the sealant does not protrude from a portion between the side surface of the small rib and the open end portion of the securing metal fitting.

2. The seal construction according to claim 1, wherein a thickness of the sealant arranged between the side surface of the small rib and the open end portion of the securing metal fitting is smaller than 3 mm.

3. The seal construction according to claim 1, wherein at least one ring portion is provided projecting radially from the outer surface of the tip portion of the sheath portion to improve sealing with the inner surface of the securing metal fitting.

4. The seal construction according to claim 1, wherein a sealant pool portion is arranged at a root portion of the small rib to which the open end portion is contacted.

5. The seal construction according to claim 1, wherein the sealant is a silicon sealant of a room temperature vulcanizing type, which hardens at a room temperature.

6. The seal construction according to claim 1, wherein the core member is a fiber reinforced plastic rod.

7. The seal construction according to claim 1, wherein a thickness of the sealant arranged between the side surface of the small rib and the open end portion of the securing metal fitting is smaller than 1 mm.

* * * * *